United States Patent [19]

Yerger

[11] 3,977,110

[45] Aug. 31, 1976

[54] DECORATIVE MARKER

[76] Inventor: Herman F. Yerger, 30 Ivy Lane, Glen Mills, Pa. 19342

[22] Filed: July 10, 1975

[21] Appl. No.: 594,667

[52] U.S. Cl. ..... 40/124.5

[51] Int. Cl.[2] ..... G09F 19/00

[58] Field of Search ..... 40/124.5, 125 R, 125 H, 40/145 R, 218; 116/173; 403/384, 386, 300; 248/221, 48, 44, 158

[56] References Cited

UNITED STATES PATENTS

| | | | |
|---|---|---|---|
| 379,688 | 3/1888 | Dennis | 403/300 X |
| 1,190,453 | 7/1916 | Pease | 40/125 R X |
| 2,148,660 | 2/1939 | Sweeney | 40/124.5 |
| 2,193,747 | 3/1940 | Thompson | 116/173 X |

*Primary Examiner*—Hugh R. Chamblee
*Assistant Examiner*—John H. Wolff
*Attorney, Agent, or Firm*—Paul & Paul

[57] ABSTRACT

A decorative marker particularly suited for use as a grave marker is disclosed. The marker comprises a one-piece molded rigid plastic assembly with an embossed decorative metalized legend on the front surface and four axially aligned bosses on the rear surface adapted for securely mounting the marker to a ground support rod and for support of a removable flagstaff.

3 Claims, 3 Drawing Figures

DECORATIVE MARKER

BACKGROUND OF THE INVENTION

This invention relates to decorative markers, and more particularly to commemorative grave markers.

Commemorative grave markers have been used for some time. Various support configurations have been employed, including assemblies involving a tripod support as well as various other single and multiple leg assemblies. Some grave markers have made provisions for supporting a removable wreath. Others, such as disclosed by U.S. Pat. No. 585,486 support a removable flag. Other markers, such as those disclosed in U.S. Pat. No. 1,400,970 are assembled from a number of separate pieces bolted, screwed, or riveted together. One-piece bonze commemorative grave markers have also been used. All of the decorative markers discussed above have one or more drawbacks. Some are costly and/or time-consuming to assemble and erect. Assembly hardware used with some marker assemblies detracts from their overall appearance and can be easily misplaced before assembly. Some of them deteriorate in outside weather conditions. Most have no provision for removably supporting a flagstaff. Some of the solid bronze commemorative markers present a security problem because, since they are easily removed and relatively valuable, they are frequently stolen.

SUMMARY OF THE INVENTION

Accordingly, it is among the objects of this invention to provide an attractive and economical decorative marker suitable for use as a grave marker.

It is another object of this invention to provide a decorative marker that is easily assembled without the necessity for separate assembly hardware.

It is another object of this invention to provide a commemorative marker capable of securely supporting a removable flagstaff at a constant specified height which provides a good esthetic appearance without obscuring the legend contained on the marker.

It is another object of this invention to provide a decorative marker assembly which is economical to produce and which will not deteriorate in weather.

It is a further object of this invention to provide a new decorative marker construction which is generally flat and requires only a minimum size package for shipment or storage.

Finally, it is an object of this invention to provide a new commemorative marker for construction which solves existing problems in the art, eliminates the described difficulties, and obtains the indicated advantages and objectives in a simple, effective and inexpensive manner.

These and other objects and advantages apparent to those skilled in the art from the following description and claims, may be obtained, the stated results achieved, and the described difficulties overcome by the construction, arrangements, combinations, parts and devices which comprise the present invention, the nature of which is set forth in the following general statement, preferred embodiments of which - illustrative of the modes in which applicants have contemplated applying the principles - are set forth in the following description and shown in the drawings and particularly and distinctly pointed out and set forth in the appended claims.

DESCRIPTION OF THE PREFERRED EMBODIMENTS

Figure 1:
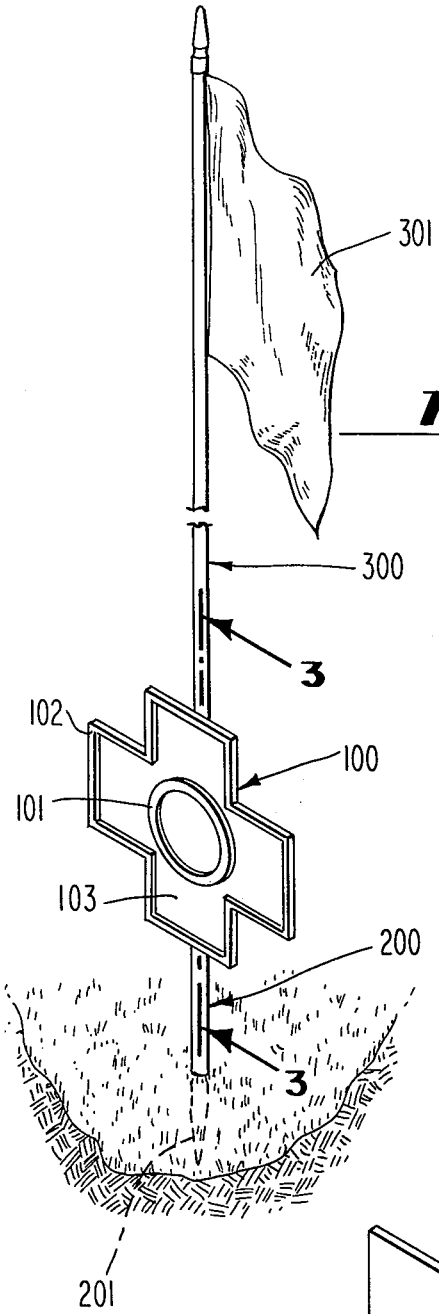
FIG. 1 is a perspective view of the decorative marker assembly, illustrating the front view of the decorative marker.

FIG. 1 shows the assembled decorative marker configuration. Decorative marker 100 is supported by ground support rod 200 which is inserted into the ground as shown. As illustrated, the ground support rod is tapered at the bottom end to facilitate insertion into the ground. An alternate configuration might involve the use of multiple prongs at the end of support rod 200, to assure rigid mounting of the marker assembly. The front surface of commemorative marker 100 comprises a decorative design. As illustrated, this design consists of a raised circle 101 and raised border 102. Flat surface 103 could contain a suitable raised legend (not illustrated).

In the preferred embodiment of this invention, commemorative marker 100 is formed as one rigid plastic assembly including a raised commemorative design on the front surface and four support bosses, to be described in detail below, on the back surface. The commemorative design is then hot stamped with brushed gold paint and oversprayed with a brown tinted epoxy to provide a protective coating. This configuration is lightweight, attractive, relatively impervious to weather, and economical and easy to manufacture. It is particularly suited to quantity production.

Figure 3:
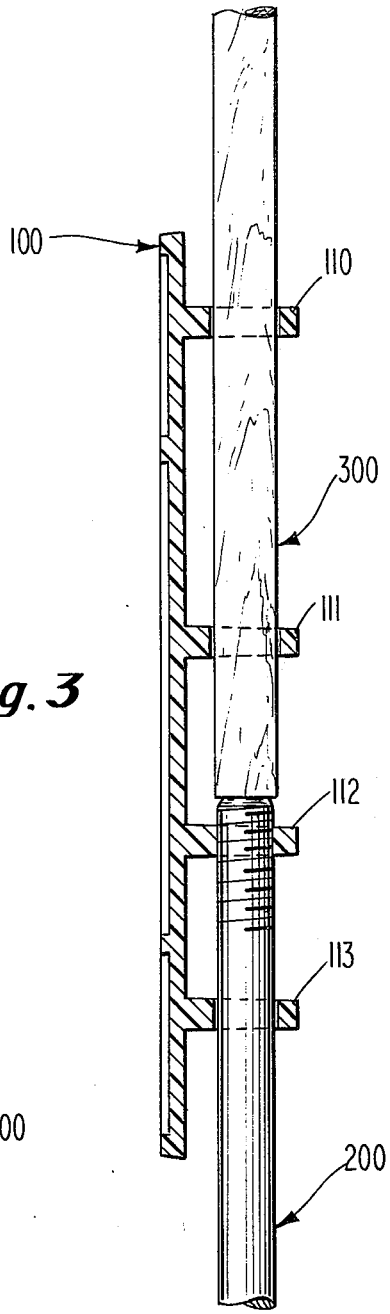
FIG. 3 is a vertical cross section of the decorative marker assembly taken along section line 3—3 of FIG. 1.
Figure 2:
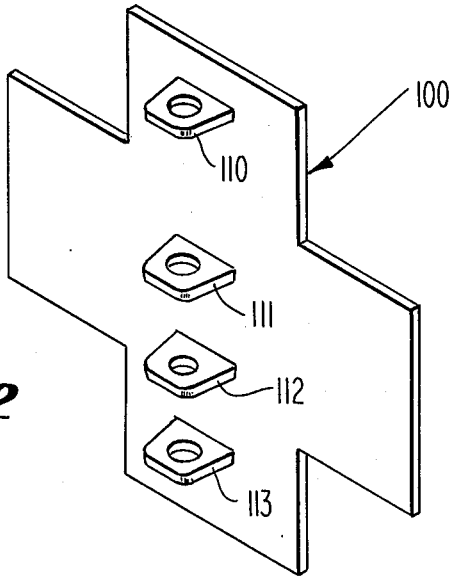
FIG. 2 is a perspective view of the back of the decorative marker.

FIG. 2 illustrates the back of marker assembly 100 and shows the four support bosses 110, 111, 112 and 113. Of course, these bosses can be of various sizes and the following dimensions are given by matter of illustration only. All bosses are approximately three-quarters of an inch square. Bosses 110 and 111 have a 13/32 inch diameter opening to accommodate flagstaff 300 as shown in FIG. 3. Boss 113 has a 0.375 inch diameter opening and boss 112 has a 0.348 inch diameter opening. When ground support rod 200 is assembled to decorative marker 100, it is forcefit through boss 113 and self-threaded into boss 112 as shown in FIG. 3. This allows for a simple, rigid assembly without the necessity of any external hardware, which is relatively impervious to weather. The result of the assembly is rigid enough to prevent inadverent twisting of the marker about the ground support rod. Ground support rod 200 is threaded somewhat past the end of boss 112 to provide a support for removable flagstaff 300, as shown in FIG. 3. This ensures that the removable flagstaff 300 can be inserted and removed easily without disturbing the orientation of the marker and ground rod assembly. It further allows selection of a flagstaff length which is esthetically pleasing and which will not allow flag 301 to obscure the face of the commemorative marker.

Since no separate assembly hardware is required, it is relatively easy to maintain a large quantity of these commemorative markers and to ship and assembly them as required. Once assembled, the ground support rod and decorative marker comprise a rigid, easily transportable assembly which can be quickly erected at the desired location.

In the foregoing description, certain terms have been used for brevity, clearness and understanding, but no unnecessary limitations are to be implied therefrom beyond the requirements of the prior art, because such words are used for descriptive purposes herein and are intended to be broadly construed.

I claim:

1. A rigid plastic decorative marker having a front decorative surface and a rear surface wherein the design of the decorative surface defines top and bottom edges of said marker, wherein mounting means on the rear surface comprises four bosses oriented perpendicular to the rear surface aligned along the vertical centerline of the marker, each boss having one aperture, wherein the apertures in the upper two bosses are concentric and sized to accommodate and support a removable flagstaff and wherein the apertures in the lower two bosses are concentric and sized to securely engage a ground support rod, the aperture, of the upper of the two lower bosses being sized to accept a selfthreading ground support rod, and the aperture of the lowest of the two lower bosses being sized to allow the shaft of the ground support rod to be forcefit.

2. A decorative marker assembly comprising:

a. A rigid plastic decorative marker having a front decorative surface and a rear surface wherein the design of the decorative surface defines top and bottom edges of said marker, wherein mounting means on the rear surface comprises four bosses oriented perpendicular to the rear surface aligned along the vertical centerline of the marker, each boss having one aperture, wherein apertures in the upper two bosses are concentric and sized to accommodate and support a removable flagstaff and wherein apertures in the lower two bosses are concentric and sized to securely engage a ground support rod, the aperture of the upper of the two lower bosses being sized to accept a selfthreading ground support rod, and the aperture of the lowest of the two lower bosses being sized to allow the shaft of the ground support rod to be forcefit;

b. A ground support rod axially inserted into and secured by said lower two bosses, said ground support rod being selfthreaded into the upper of the lower two bosses to ensure that the resultant assembly is rigid, and wherein the bottom end of the ground support rod is pointed to facilitate insertion into the ground.

3. The apparatus according to claim 2, wherein the top of the ground support rod is threaded entirely through the upper of the lower two bosses to provide a support for the bottom end of the removable flagstaff.

* * * * *